US006447245B1

(12) United States Patent
Oakley et al.

(10) Patent No.: US 6,447,245 B1
(45) Date of Patent: Sep. 10, 2002

(54) ROTODYNAMIC PUMP

(75) Inventors: Timothy Oakley, Worcestershire (GB); Geoffrey Howard Clements, Worcestershire (GB)

(73) Assignee: Sweepax International Limited, Worcester (GB)

( * ) Notice: Subject to any disclaimer, the term of this patent is extended or adjusted under 35 U.S.C. 154(b) by 0 days.

(21) Appl. No.: 09/799,449

(22) Filed: Mar. 5, 2001

(Under 37 CFR 1.47)

Related U.S. Application Data

(63) Continuation of application No. 09/331,136, filed as application No. PCT/GB97/01577 on Jun. 11, 1996, now Pat. No. 6,241,470.

(30) Foreign Application Priority Data

Jun. 11, 1996 (GB) ..... 9612201

(51) Int. Cl.[7] ..... F04D 29/70

(52) U.S. Cl. ..... 415/121.1; 415/121.2; 415/191; 415/199.5; 415/199.6; 415/206; 415/208.2

(58) Field of Search ..... 415/121.1, 121.2, 415/121.3, 191, 199.4, 199.5, 199.6, 208.2, 206

(56) References Cited

U.S. PATENT DOCUMENTS

| | | | | |
|---|---|---|---|---|
| 3,627,280 A | | 12/1971 | Fridman et al. | |
| 3,650,481 A | | 3/1972 | Conery et al. | |
| 4,141,510 A | | 2/1979 | Smith | |
| 4,150,916 A | * | 4/1979 | Tsutsui et al. | 415/143 |
| 4,400,134 A | | 8/1983 | Sweeney | |
| 4,454,993 A | | 6/1984 | Shebata et al. | |
| 4,527,947 A | | 7/1985 | Elliott | |
| 4,728,256 A | * | 3/1988 | Araoka | 415/121.1 |
| 4,776,756 A | * | 10/1988 | Sweeney | 415/122.1 |
| 4,826,398 A | | 5/1989 | Gullichsen | |
| 4,877,368 A | | 10/1989 | Timperi | |
| 5,238,363 A | | 8/1993 | Thielke et al. | |

FOREIGN PATENT DOCUMENTS

| | | |
|---|---|---|
| AT | 219420 | 1/1962 |
| CH | 102604 | 12/1923 |
| DE | 1 813 864 | 7/1969 |
| DE | 25 18 179 A1 | 11/1976 |
| DE | 44 38 841 C1 | 8/1996 |
| EP | 0 278 388 A2 | 8/1988 |

* cited by examiner

*Primary Examiner*—Edward K. Look
*Assistant Examiner*—Ninh Nguyen
(74) *Attorney, Agent, or Firm*—Patterson, Thuente, Skaar & Christense, P.A.

(57) ABSTRACT

A rotodynamic pump comprising a centrifugal impeller (11) provided within a volute body (7) and an emulsifier (17) provided in the region of an inlet of the volute body and rotatable with the centrifugal impeller for emulsifying material to be pumped.

31 Claims, 5 Drawing Sheets

ROTODYNAMIC PUMP

This application is a continuation of Ser. No. 09/331,136 filed Jun. 16, 1999 now U.S. Pat. No. 6,241,470 which is the national stage of PCT/GB 97/01577 with an International filing date of Jun. 11, 1996.

BACKGROUND OF THE INVENTION

1. Field of the Invention

The present invention relates to a rotodynamic pump which may be, for example, mobile.

2. Background

Liquids which contain a high proportion of solids, such as sludges, slurries, and fibrous and viscous liquids are particularly difficult to pump, especially when the material to be pumped has been standing for some time. Typically, such materials are stored in open lagoons and there is increasing environmental pressure to empty and clean these lagoons.

SUMMARY OF THE INVENTION

It is therefore an object of the present invention to provide a rotodynamic pump which is capable of pumping liquids containing a high proportion of solids.

According to the invention there is provided a rotodynamic pump comprising a centrifugal impeller provided within a volute body and an emulsifier provided in the region of an inlet of the volute body and rotatable with the centrifugal impeller for emulsifying material to be pumped.

The emulsifier may comprise a plurality of emulsifying blades extending in the axial direction of the centrifugal impeller and spaced laterally from the axis thereof. The emulsifying blades may be mounted on a base plate arranged at that end of the blades remote from the centrifugal impeller. The blades may have a hydrofoil shape or may be arcuate or straight and may be provided with a relatively sharp leading edge. The shape of the blades may depend upon the nature of the material to be pumped.

The pump may include an auger member rotatable with the centrifugal impeller and disposed in the region of the inlet of the volute body. The auger member may be positioned within the emulsifier.

The centrifugal impeller may incorporate a plurality of impeller blades, the blades being dimensioned to be shorter than the axial height of the volute body. The blades may be about half the axial height of the volute body.

The emulsifier may be positioned within a protective cage. The protective cage may comprise an annular ring positioned on that side of the emulsifier remote from the centrifugal impeller and secured to the volute body.

A plurality of nozzles for emollient injection may be provided around the emulsifier, for example intermediate the emulsifier and the protective cage. The nozzles may be directed in the axial direction. The nozzles may be secured to the underside of the volute body.

A stationary member may be positioned adjacent to the emulsifier for macerating the material to be pumped. The stationary member may comprise a plurality of stationary blades extending in the axial direction and spaced laterally of the axis, the stationary blades being positioned radially within the blades of the emulsifier. The stationary blades may be secured to the volute body. The stationary blades may have a hydrofoil shape or may be arcuate or straight. The shape of the blades may depend upon the nature of the material being pumped. The radially outer end of each stationary blade may be relatively sharp for co-operation with the blades of the emulsifier.

For a better understanding of the present invention and to show more clearly how it may be carried into effect reference will now be made, by way of example, to the accompanying drawings in which:

DETAILED DESCRIPTION OF THE INVENTION

Figure 1:
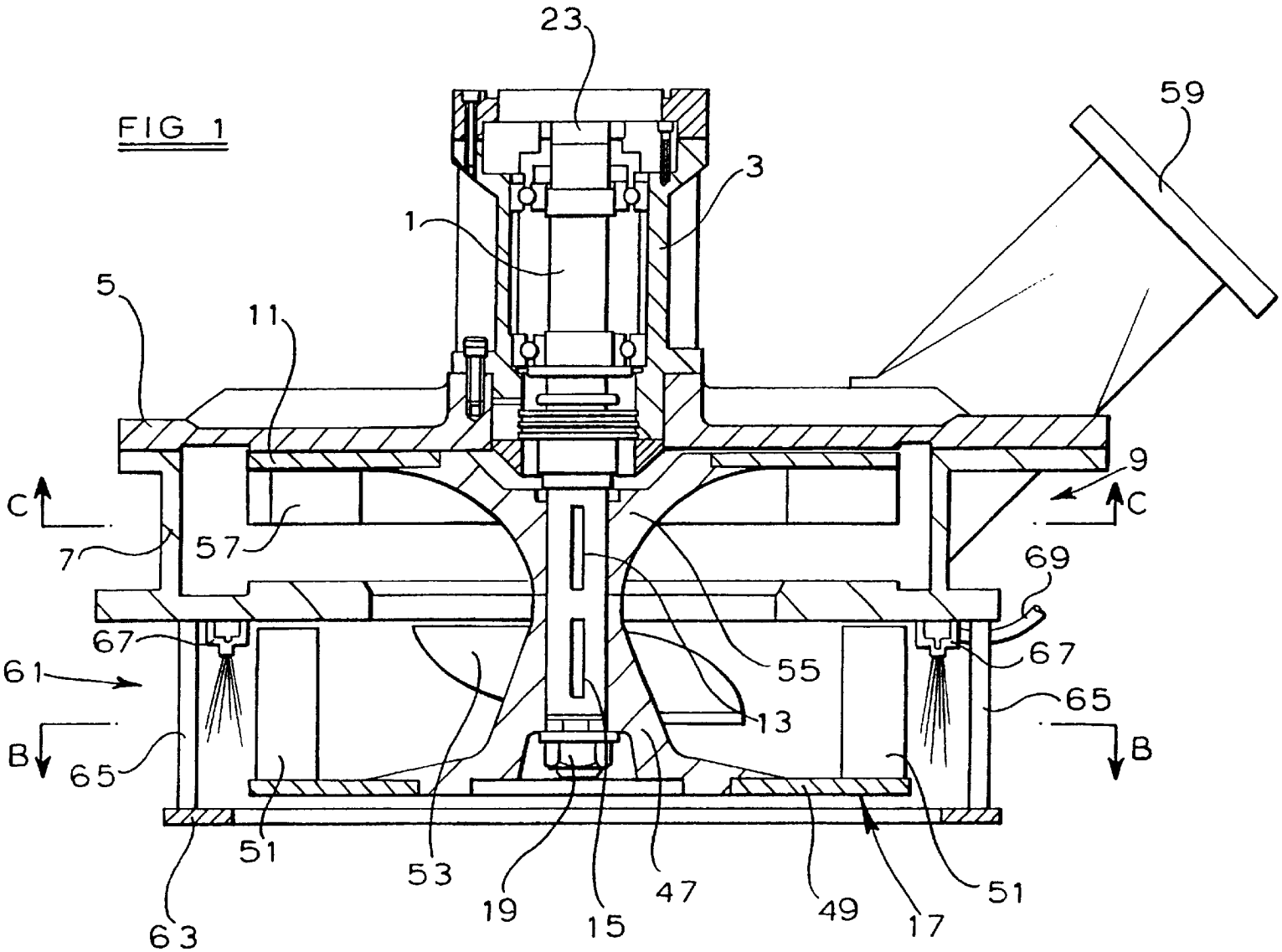
FIG. 1 is a longitudinal cross-sectional view of one embodiment of a rotodynamic pump according to the present invention.

FIGS. 1 to 4 show a mobile submersible rotodynamic pump according to the present invention, the pump comprising an elongate upright rotary shaft 1 mounted at the upper end thereof in a sealed lubricated bearing housing 3. The bearing housing 3 is mounted on a cover 5 of a volute body 7 of a rotodynamic pump 9 having a centrifugal impeller 11. The centrifugal impeller 11 is rotatable with the rotary shaft 1, for example by way of a key 13.

The lower region of the shaft 1 is secured, for example by way of key 15, to an emulsifier 17 such that the emulsifier is rotatable with the shaft 1.

The impeller 11 and emulsifier 17 are retained on the shaft 1 by a nut 19 screwed to a thread 21 provided at the lower end of the rotary shaft 1. The upper end of the rotary shaft is provided with a coupling 23 for connecting the shaft 1 to rotary drive means (not shown in FIGS. 1 to 4).

Figure 4:
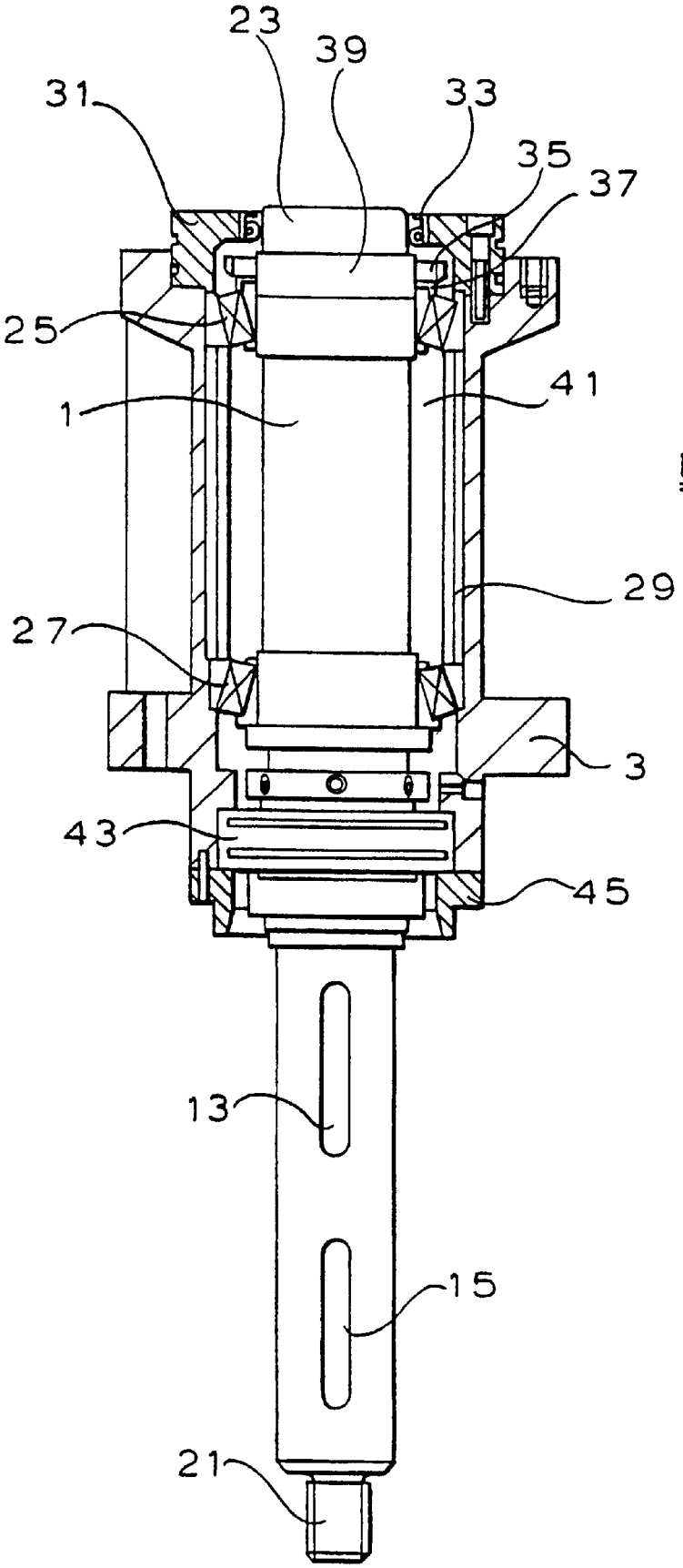
FIG. 4 is an elevational view of a rotary shaft and bearing housing forming part of the rotodynamic pump according to the present invention.

With particular reference to FIG. 4, the bearing housing 3 incorporates two bearings 25 and 27 positioned a predetermined distance apart by means of a spacer sleeve 29. The upper end of the bearing housing is provided with a top bearing seal housing 31 for retaining a lip shaft seal 33.

A lock nut 35 and lock washer 37 are provided on a threaded portion 39 in the region of the upper end of the shaft 1. Rotation of the lock nut 35 adjusts the pre-load tension of the bearings 25 and 27.

A generally cylindrical chamber 41 is formed between the shaft 1 and the spacer sleeve 29 and contains coolant for the bearings 25 and 27 and the seal 33.

The lower region of the bearing housing 3 is provided with a heavy duty mechanical shaft seal 43 constrained and held in place by a retaining cap 45 secured to the lower end of the bearing housing 3.

Figure 2:
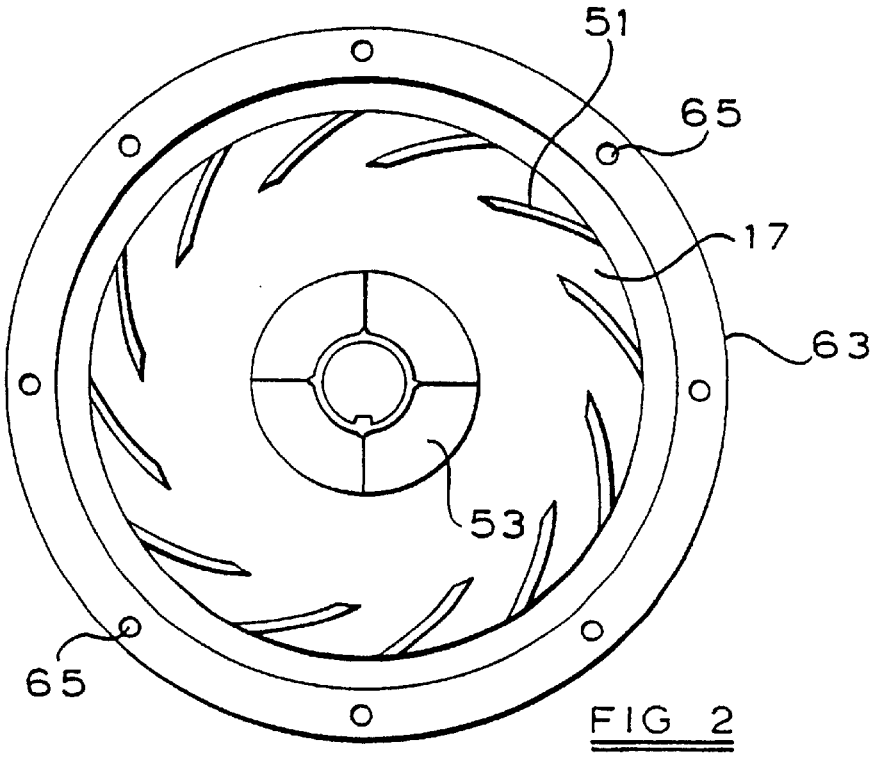
FIG. 2 is a plan view taken along the line B—B shown in FIG. 1.

The lower section of the pump is shown in FIGS. 1 and 2 and comprises emulsifier 17 provided in the region of an inlet of the volute body and which is in the form of a generally frustoconical member 47 secured to the shaft 1, with that part of the member 47 of smaller cross-sectional area being uppermost, and an annular base plate 49 secured to the frustoconical member 47, although the shape of the member 47 need not be frustoconical. Secured to the upper surface of the peripheral region of the annular base plate 49 is a plurality of upstanding emulsifying blades 51, i.e. the blades 51 extend in the axial direction of the rotary shaft 1. The precise configuration of the blades 51 is not important, but in the illustrated embodiment the blades are arcuate in shape with the ends of the blades being shaped so as to extend circumferentially such that the leading edge at least of the blades is relatively sharp. Alternatively, the blades 51 may be straight, in which case it is preferable that the blades should be inclined relative to the direction of movement and should be configured such that at least the outer ends of the blades extend generally circumferentially such that the leading edge of the blades is relatively sharp. The function of the blades 51 will be described in more detail hereinafter, but essentially the purpose of the blades is to cut through the material to be pumped so as to shear thin and emulsify the material. Thus, in effect emulsified, pumpable material collects in a pool radially inwardly of the blades 51. Formed around the member 47 is an auger member 53 which has the effect of urging the emulsified material in an upward axial direction according to FIG. 1. The presence of the pump member 53 is not essential, but assists in feeding emulsified material to the rotodynamic pump to be described hereinafter.

Figure 3:
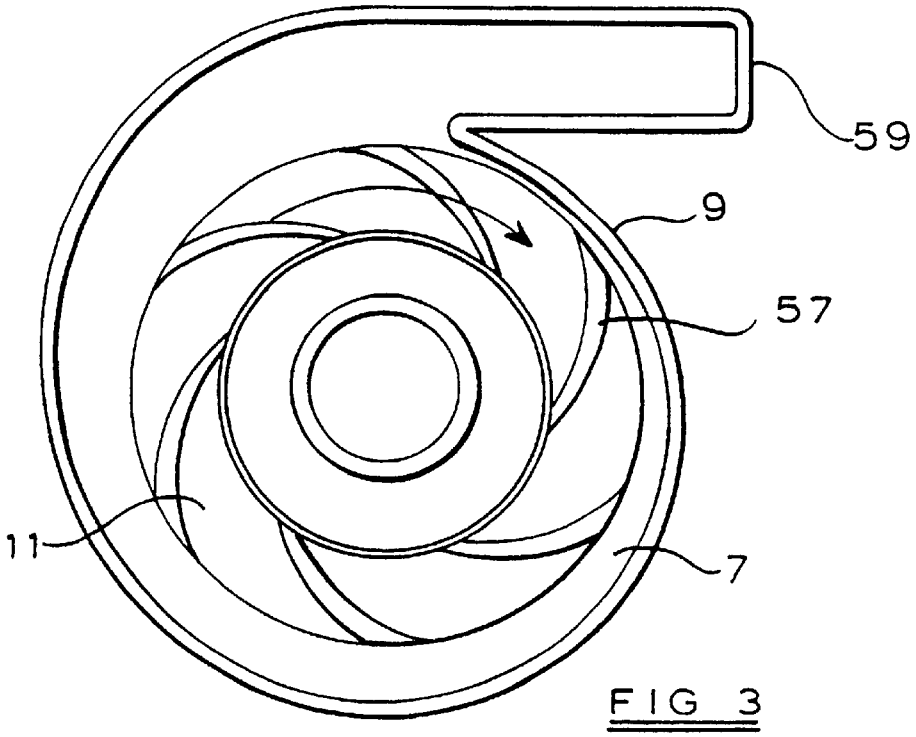
FIG. 3 is a plan view taken along the line C—C shown in FIG. 1.

The upper section of the pump is shown in FIGS. 1 and 3 and comprises impeller 11 which is mounted at the upper end of an inverted frustoconical member 55. The lower end of member 55 abuts the upper end of member 47. Although the frustoconical shape of the members 47 and 55 may promote streamline flow, we have found that this is not important and either or both of the members 47 and 55 need not be frustoconical in shape. A plurality, six as illustrated in FIG. 3, of blades 57 are mounted on the underside of impeller 11 and extend downwardly therefrom. As can be seen from FIG. 3, the blades 57 are curved backwardly relative to the (clockwise) direction of rotation of the impeller. We have found that it is not essential for the blades 57 to extend radially inwardly to the member 55 and that a relatively short radial extent is sufficient. Moreover, we have found that it is not essential for the blades 57 to extend the entire axial height of the volute body 7: indeed, we can at times obtain more efficient pumping when the blades extend only about half the axial height of the volute body.

Secured to the underside of the volute body 5 and extending around and beneath the emulsifier 17 is a protective cage 61. The protective cage 61 comprises an annular ring 63 positioned beneath (as shown in FIG. 1) the emulsifier 17 and secured to the underside of the volute body 7 by means of a plurality of axially extending members 65. The protective cage has the effect of preventing the emulsifier 17 from engaging directly with the bottom of a lagoon or the like while not significantly restricting the movement of material to be pumped to the emulsifying blades 51.

Secured to the underside of the volute body 7 and positioned radially between the emulsifying blades 51 and the upright members 65 of the protective cage 61 is a plurality of water jets 67 positioned circumferentially around the blades 51. The water jets 67 are directed in the axial direction of the rotary shaft 1 and are mounted on a circumferentially extending water supply which is supplied with water through a pipe 69.

The cover 5 is provided with a raised discharge aperture 59 which can be connected to a discharge hose (not shown in FIGS. 1 to 4). The cover 5 may also be provided with means (not shown in FIGS. 1 to 4) to permit the pump to be lowered into and raised from a lagoon or the like of material to be pumped.

The top of the bearing housing 3 is provided with means (not shown) for attaching a powered rotary drive (not shown in FIGS. 1 to 4), such as an hydraulic drive, for driving the rotary shaft 1.

In use of the pump shown in FIGS. 1 to 4, we have found that the pump is capable of pumping materials containing up to 45 percent or more by weight dry solids at up to about 185 cubic meters per hour depending on the size of the pump. Many materials containing such a high proportion of solids were previously considered to be incapable of being pumped. Moreover, we have found that the pump described herein is self priming and is not affected by the inclusion of air in the material to be pumped.

A relatively small pump may operate at up to about 1500 rpm, at which speed it is capable of pumping up to about 60 cubic meters per hour of material depending on the nature of the material, while a larger pump may operate at up to about 950 to 1200 rpm, at which speeds it is capable of pumping up to about 185 cubic meters per hour of material depending on the nature of the material.

The pump can be used to pump material out of lagoons, for dredging material out of waterways such as canals, rivers and harbours or the like or can be mounted in a tank containing high solids materials and used to circulate the material in the tank in order to maintain the material in a liquid state.

When used in a lagoon or waterway, the pump is lowered into the material to be pumped, for example by being mounted on the end of an hydraulic arm, being suspended from a crane boom, or simply by sliding the pump down a skid. The pump will in effect excavate its way into the material to be pumped, emulsifying the material and converting it to a pumpable medium as it rotates.

The blades 51 as they rotate apply shear to the material in which the pump is located, the shear forces tend to emulsify or "shear thin" the material and reduce it to a liquified, pumpable form. We have found that the positioning of the blades 51 in the axial direction of the rotary shaft 1 is important in the effective operation of the pump. The surface area of the cylinder swept by the blades 51 is greater than the cross-sectional area of the discharge aperture 59 and this gives the pump the opportunity to accumulate a significant pool of liquified material within the cylinder swept by the blades 51. The liquified material is then drawn into the volute chamber by the impeller blades 57 and discharged from the pump. We have found that it is not necessary to provide a large number of impeller blades and that it is not necessary for the impeller blades to extend the entire height of the volute chamber: indeed it may be that the reduced height of the impeller blades gives rise to further shear thinning of the material which permits the liquified material to be pumped a significant distance from the pump. The auger member, where provided, assists in urging liquified material towards the volute chamber and may additionally promote further shear thinning of the material.

The use of a ring of emollient jets 67, for example water, around the emulsifying blades 51 further improves the ability of the pump to liquify high solids materials. It is not necessary that the emollient should be at high pressure, but we have found, for example, that by providing sufficient emollient to reduce the solids content from 44 percent by weight dry solids to 33 percent dry solids, i.e. a reduction of 25 percent in the solids content, the flow through the pump could be increased by about 300 percent.

The pump may, of course, be powered by means other than a diesel/hydraulic drive, such as by electric/hydraulic power or a submersible electric motor.

In situations where the pump is likely to be required to deal with vegetation and other debris such as might be found in sewage or the like, the emulsifying blades 51 may be used in conjunction with a plurality of stationary blades in order to macerate the material as it enters the pump. Such an embodiment of the pump is shown in FIGS. 5 and 6.

Figure 5:
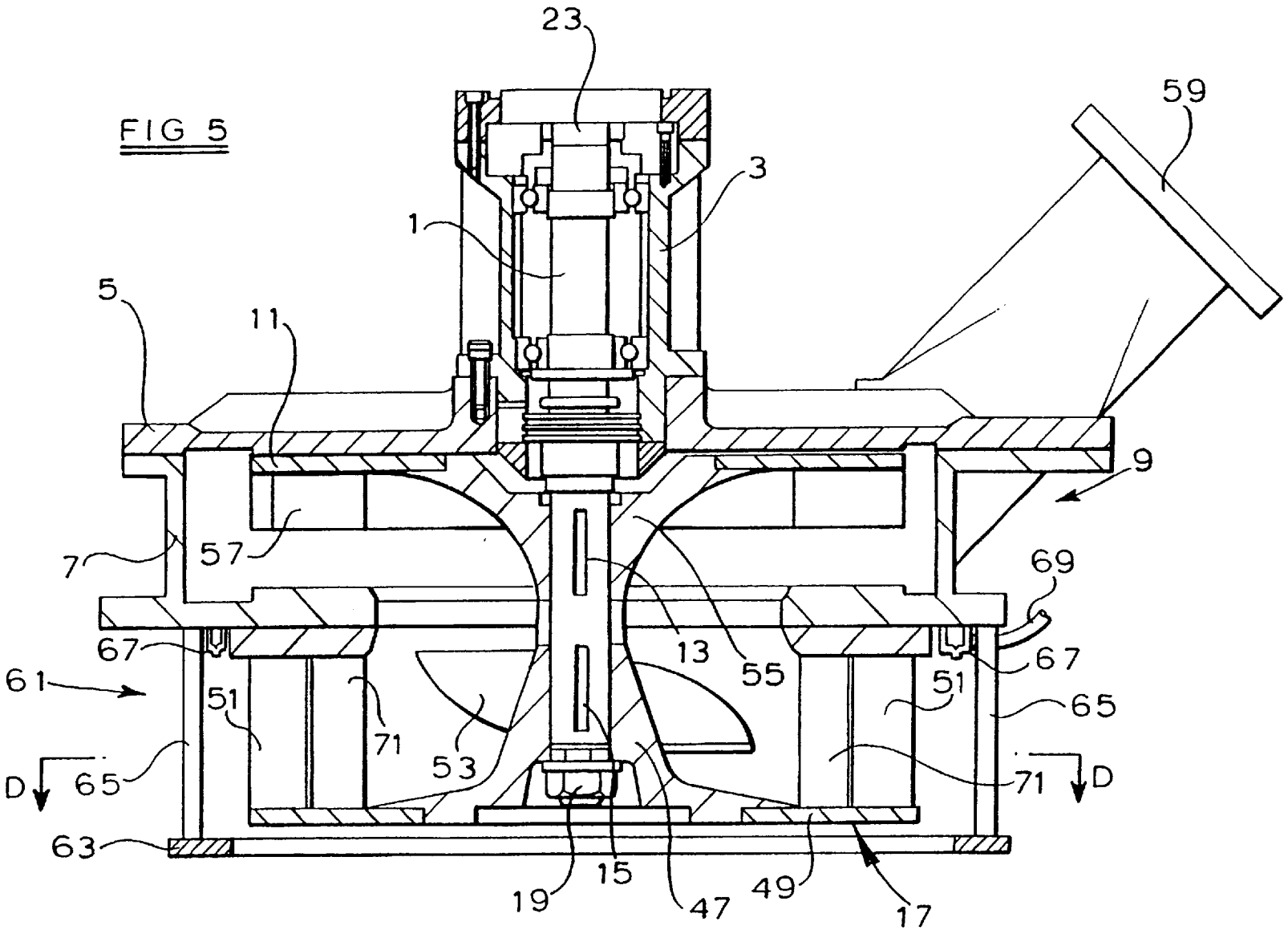
FIG. 5 is a vertical cross-sectional view of another embodiment of a rotodynamic pump according to the present invention.
Figure 6:
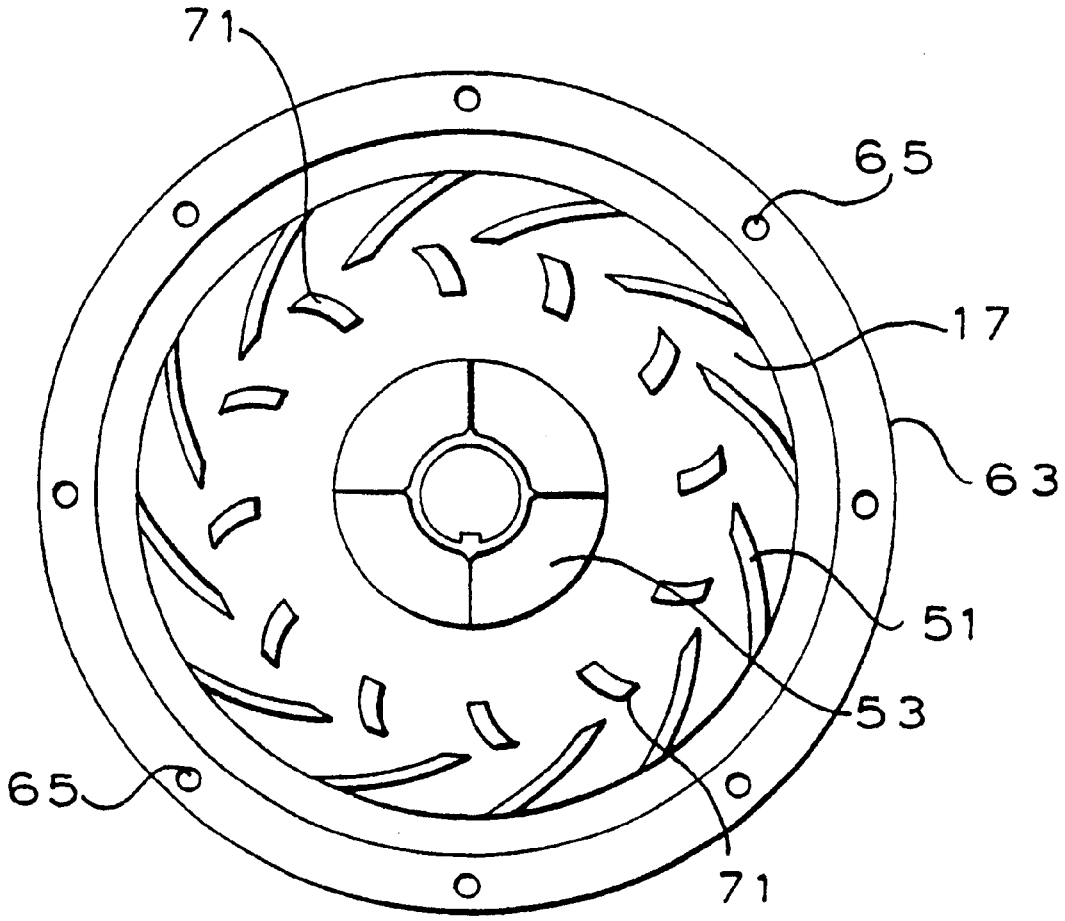
FIG. 6 is a plan view taken along the line D—D shown in FIG. 5.

The pump shown in FIGS. 5 and 6 is essentially the same as that shown in FIGS. 1 to 4 and the same or similar parts are identified with the same reference numerals. However, the pump shown in FIGS. 5 and 6 additionally incorporates a plurality of stationary macerating blades 71 secured to the underside of the volute body 7 and extending downwardly, that is in the axial direction of the rotary shaft 1, in a ring internally of the emulsifying blades 51.

The precise configuration of the blades 71 is not important, but in the illustrated embodiment the blades are arcuate in shape with the ends of the blades being shaped so as to extend circumferentially such that the leading edge at least of the blades is relatively sharp. As shown in FIG. 6, the blades 71 may extend arcuately in a manner such that the radially inwardly portion of the blade extends in a radial direction. Alternatively, the blades 71 may be straight, in which case it is preferable that the blades should be inclined relative to the direction of movement and should be configured such that at least the outer ends of the blades extend generally circumferentially such that the leading edge (i.e. that edge adjacent to the blades 51) of the blades is relatively sharp.

The effect of the stationary blades 71 in conjunction with the blades 51 is to macerate any vegetation, debris or the like in the material to be pumped.

What is claimed is:

1. A rotodynamic pump, comprising:

a volute body with an inlet and an axial dimension;

a centrifugal impeller disposed in the volute body and having an axis, the centrifugal impeller comprising a plurality of impeller blades, the impeller blades dimensioned to be substantially half the axial dimension of the volute body;

an emulsifier disposed proximate the volute body inlet, and rotatable with the centrifugal impeller and configured for emulsifying material to be pumped, the emulsifier comprising a plurality of emulsifying blades extending axially of the centrifugal impeller and spaced laterally from the centrifugal impeller axis; and a stationary member positioned adjacent the emulsifier and comprising a plurality of stationary blades axially extending, spaced laterally from the centrifugal impeller axis, and located radially inwardly of the emulsifying blades, the stationary blades configured for macerating the material to be pumped in conjunction with the emulsifying blades.

2. The pump of claim 1, the emulsifier further comprising a base plate, wherein the emulsifying blades are mounted on the base plate arranged at an end of the blades remote from the centrifugal impeller.

3. The pump of claim 1, wherein the shape of the blades is selected from a hydrofoil shape, arcuate and straight.

4. The pump of claim 1, wherein the emulsifying blades are provided with a relatively sharp leading edge.

5. The pump of claim 1, further comprising an auger member, the auger member rotatable with the centrifugal impeller and disposed in the inlet of the volute body.

6. The pump of claim 5, wherein the auger member is positioned within the emulsifier.

7. The pump of claim 1, further comprising a protective cage and wherein the emulsifier is positioned within the protective cage.

8. The pump of claim 7, the protective cage comprising an annular ring positioned on a side of the emulsifier remote from the centrifugal impeller and secured to the volute body.

9. The pump of claim 1, further comprising a plurality of nozzles for emollient injection, the plurality of nozzles disposed around the emulsifier.

10. The pump of claim 9, wherein the nozzles are directed in the axial direction.

11. The pump of claim 9, the volute body displaying an underside and wherein the nozzles are secured to the underside of the volute body.

12. The pump of claim 1, further comprising a plurality of nozzles for emollient injection, the plurality of nozzles disposed around the emulsifier such that the nozzles are intermediate the emulsifier and the protective cage.

13. The pump of claim 1, each stationary blade displaying a radially outer end and wherein the radially outer end of each stationary blade is relatively sharp.

14. The pump of claim 1, wherein the stationary blades are secured to the volute body.

15. The pump of claim 1, wherein the stationary blades have a shape selected from a hydrofoil shape, arcuate, and straight.

16. The pump of claim 15, the emulsifier further comprising a base plate, wherein the emulsifying blades are mounted on the base plate arranged at an end of the blades remote from the centrifugal impeller.

17. The method of claim 16, in which the rotodynamic pump is immersed in one of a canal, a river, a harbour, a tank, and a lagoon.

18. The method of claim 16, in which activating the pump comprises macerating debris present in the liquid.

19. The method of claim 18, in which the macerated debris comprises vegetation.

20. The method of claim 16, in which the pumped liquid is circulated.

21. The method of claim 16, in the activated rotodynamic pump excavates through the solids, thereby emulsifying the solids.

22. A method of pumping a liquid with a proportion of solids, comprising:

providing a volute body having an axial dimension;

installing a centrifugal impeller within the volute body such that the centrifugal impeller rotates, the centrifugal impeller comprising a plurality of impeller blades, the impeller blades being dimensioned to be substantially half the axial dimension of the volute body;

attaching an emulsifier to the centrifugal impeller in the region of an inlet of the volute body such that the emulsifier rotates with the centrifugal impeller, the emulsifier comprising a plurality of emulsifier blades extending in an axial direction of the centrifugal impeller and spaced laterally from the axis thereof; and positioning a stationary member adjacent the emulsifier, the stationary member comprising a plurality of stationary blades extending axially and spaced laterally from a centrifugal impeller axis and located radially inwardly of the emulsifying blades.

23. The method of claim 22, the attached emulsifier further comprising a base plate, the emulsifying blades mounted on the base plate, and in which the attaching the emulsifier base plate is opposed to the centrifugal impeller.

24. The method of claim 22, further comprising disposing an auger proximate the inlet of the volute body such that the auger is rotatable with the centrifugal impeller.

25. The method of claim 24, in which the auger is positioned within the emulsifier.

26. The method of claim 22, further comprising positioning the emulsifier in a protective cage.

27. The method of claim 22, further comprising disposing a plurality of nozzles around the emulsifier.

28. The method of claim 27, in which the nozzles are disposed in an axial direction.

29. The method of claim 28, in which the nozzles are secured to the underside of the volute body.

30. The method of claim 29, further comprising positioning the emulsifier in a protective cage and in which the nozzles are intermediate the emulsifier and the protective cage.

31. The method of claim 22, further comprising securing the stationary blades to the volute body.

* * * * *